US005644856A

United States Patent [19]

Bray, Jr.

[11] Patent Number: 5,644,856

[45] Date of Patent: Jul. 8, 1997

[54] WEDGE SLIPPER

[75] Inventor: Walter T. Bray, Jr., Reynoldsburg, Ohio

[73] Assignee: R.G. Barry Corporation, Pickerington, Ohio

[21] Appl. No.: 607,980

[22] Filed: Feb. 29, 1996

[51] Int. Cl.[6] ..... A43B 3/12; A43B 9/10

[52] U.S. Cl. ..... 36/11.5; 36/16; 36/19 R; 12/142 S

[58] Field of Search ..... 36/11.5, 16, 19 R, 36/19 A, 30 A; 12/142 A, 142 B, 142 G, 142 S

[56] References Cited

U.S. PATENT DOCUMENTS

| | | |
|---|---|---|
| D. 190,164 | 4/1961 | Lacek . |
| D. 326,181 | 5/1992 | Katz et al. . |
| D. 347,518 | 6/1994 | Stewart . |
| 910,778 | 1/1909 | Borchardt . |
| 992,221 | 5/1911 | Loewenbach . |
| 1,410,907 | 3/1922 | Garfinkle . |
| 1,546,253 | 7/1925 | Roth . |
| 1,770,698 | 7/1930 | Horowitz . |
| 1,916,067 | 6/1933 | Naidor . |
| 2,226,110 | 12/1940 | Bass . |
| 2,996,814 | 8/1961 | Baker . |
| 3,051,971 | 9/1962 | Westberg . |
| 3,095,656 | 7/1963 | Lipare . |
| 3,416,174 | 12/1968 | Novitske . |
| 4,145,822 | 3/1979 | Mitchell et al. . |
| 4,620,495 | 11/1986 | Ganon . |
| 4,889,412 | 12/1989 | Ganon . |
| 5,012,541 | 5/1991 | Ganon . |
| 5,033,144 | 7/1991 | Ganon . |
| 5,392,532 | 2/1995 | Bray, Jr. et al. . |

FOREIGN PATENT DOCUMENTS 5-111403 5/1993 Japan .

OTHER PUBLICATIONS

Dearfoams® Fall/Winter 1995 publication of R.G. Barry Corporation dated Apr. 1995.
Photographs of prior art wedge slipper of R.G. Barry Corporation.
Photographs of prior art leather slipper of International C&J Limited.
Photographs of prior art fabric wedge slipper.
Dearforms® Fall/Winter 1992 publication of R.G. Barry Corporation.
Dearforms® Fall/Winter 1993 publication of R.G. Barry Corporation.
Dearforms® Spring/Summer 1994 publication of R.G. Barry Corporation.
S. Goldberg & Co., Inc. Catalog, Spring 1970, Style 495.
S. Goldberg & Co., Inc. Catalog, Spring 1975, Style 5974.
S. Goldberg & Co., Inc. Catalog, Spring 1980, Style 5991.
S. Goldberg & Co., Inc. Catalog, Fall 1983, Styles 4941, 5971.
S. Goldberg & Co., Inc. Catalog, Fall 1984, Styles C502, L101.
S. Goldberg & Co., Inc. Catalog, Fall 1990, Style 6887.
S. Goldberg & Co., Inc. Catalog, Fall 1993, Styles 506, 509, 511, 5110.

*Primary Examiner*—Ted Kavanaugh
*Attorney, Agent, or Firm*—Merchant, Gould, Smith, Edell, Welter & Schmidt

[57] ABSTRACT

A wedge slipper includes an all fabric construction with a flat rubber outsole. A wedge cover is stitched to the outsole with a bottom peripheral edge of the wedge cover turned inwardly to avoid presenting exposed stitching. The insole and the wedge cover are stitched together with both the insole and wedge cover turned inwardly at the line of stitching. Into a toe portion of the outsole with a ribbon covering raw edges of the vamp and the insole. A cushion filler of increased thickness is placed within a cavity defined between the outsole and the insole with an enlarged thickness portion of the filler received in the heel cavity.

11 Claims, 14 Drawing Sheets

WEDGE SLIPPER

I. BACKGROUND OF THE INVENTION

1. Field of the Invention

This invention pertains to a slipper. More particularly, this invention pertains to a novel design and construction of a slipper having an enlarged thickness heel area.

2. Description of the Prior Art

Wedge slippers are well known. Traditional wedge slippers are commonly constructed using hard wedges made of molded styrofoam or carved wood combined with an assembly method which utilized adhesives for attaching fabric uppers, bottoms and wedge components together. The wedge slippers could be made of fabric coverings or leather coverings. In the case of leather coverings, the various elements were lasted as is common in leather footwear products. Wearers of such prior art wedge slippers were forced to contend with inherent product features such as hard, unforgiving wedges which require the wearer's heel and arch to conform to the molded shape of the hardened ridged wedge.

Another wedge style slipper of the prior art includes a fabric covering surrounding the wedge area of the heel of the slipper. The fabric covering is applied to a molded outsole in a manner which exposes stitching. Also, such prior art fabric wedge slippers required a construction which resulted of raw edges of an insole and vamp being exposed. Such a construction with exposed edges can be either uncomfortable or unsightly.

It is an object of the present invention to provide a wedge slipper of novel construction. More particularly it is an object of the present invention to provide such a slipper which offers traditional styling of wedge slippers and which is lightweight, flexible and washable.

II. SUMMARY OF THE INVENTION

According to a preferred embodiment of the present invention, an article of footwear is provided which includes an outsole and a cushion filler positioned on the outsole. The cushion filler has an enlarged thickness portion in the heel area of the filler. A fabric cover surrounds the enlarged thickness portion. A bottom peripheral edge of the fabric cover is stitched to the outsole with a finished surface of the cover turned at the bottom peripheral edge such that the finished surface faces an upper surface of the outsole. A fabric insole lays over the filler. At the heel end, both the fabric insole and the upper peripheral edge of the cover are turned such that the finished surfaces of the insole and the cover face one another. These finished surfaces are stitched together. A fabric vamp covers the insole at the toe area of the slipper. At the peripheral edge of the vamp and inner surface of the vamp faces a finished surface of the insole. An unfinished surface of the insole faces the upper surface of the outsole. The vamp, insole and outsole are stitched together and may be provided with a ribbon covering raw edges of the vamp and the insole.

III. A BRIEF DESCRIPTION OF THE DRAWINGS

IV. DESCRIPTION OF THE PREFERRED EMBODIMENT

Figure 1:
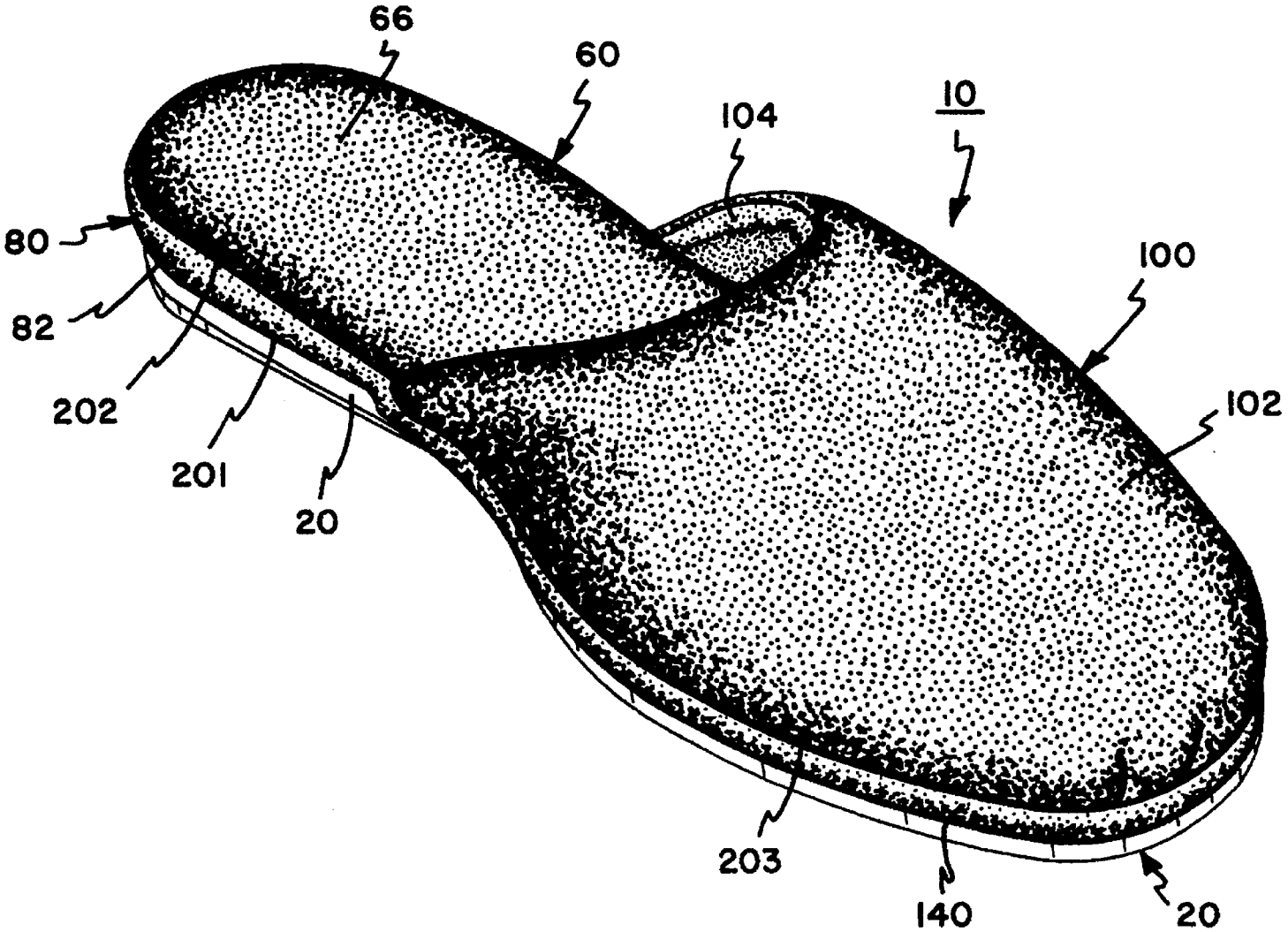
FIG. 1 is a front, right and top perspective view of an article of footwear according the present invention.
Figure 3:
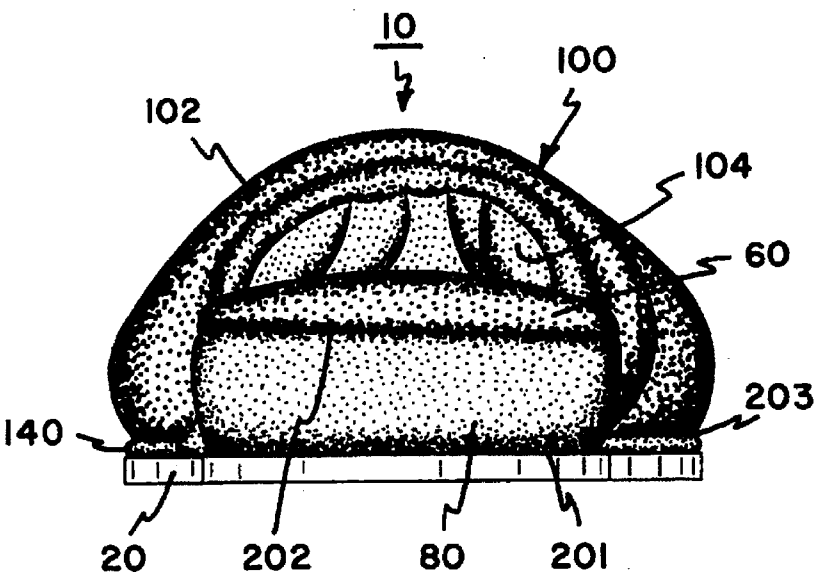
FIG. 3 is a back or heel end elevation view of the footwear of FIG. 1.
Figure 2:
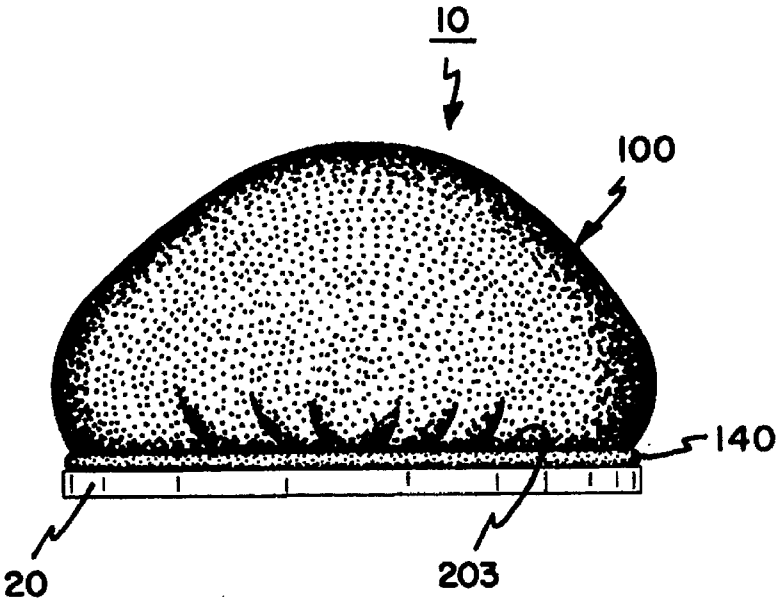
FIG. 2 is a front end elevation view of the footwear of FIG. 1.

Referring now to the several drawing figures in which identical elements are numbered identically throughout, a description of the preferred embodiment to the present invention will now be provided.

A novel article of footwear is shown in the form of a slipper 10 having the styling of a so-called wedge slipper. The slipper is formed completely of washable material and includes a plurality of fabric members as will be described which are stitched together surrounding a cushioned filler to provide a soft contoured finished silhouette allowing soft, finished edges to conform to the wearer's foot without yielding the heel and arch support found in traditional wedge styled slippers. Further, as will be more fully described, the novel slipper includes a construction technique which avoids the unsightly exposure of stitching or raw edges of the fabric components.

With initial reference to FIG. 10, the slipper 10 includes an outsole 20 a filler 40, an insole 60, a wedge cover 80, a vamp 100, and a ribbon 140 which are secured together through stitching as will be described.

Referring first to the outsole 20, the outsole is preferably molded rubber material and extends from a toe end 22 to a heel end 24. The outsole 20 is shaped to conform generally with the sole of the wearer's foot.

The outsole 20 includes a generally flat bottom surface 26 which may be provided with a rough texture for slip resistance. A ridge 27 is provided to retain and protect stitching as will be described. The outsole 20 has a flat upper surface 28 which is generally parallel to the bottom surface 26 as best shown in FIG. 10.

Figure 4:
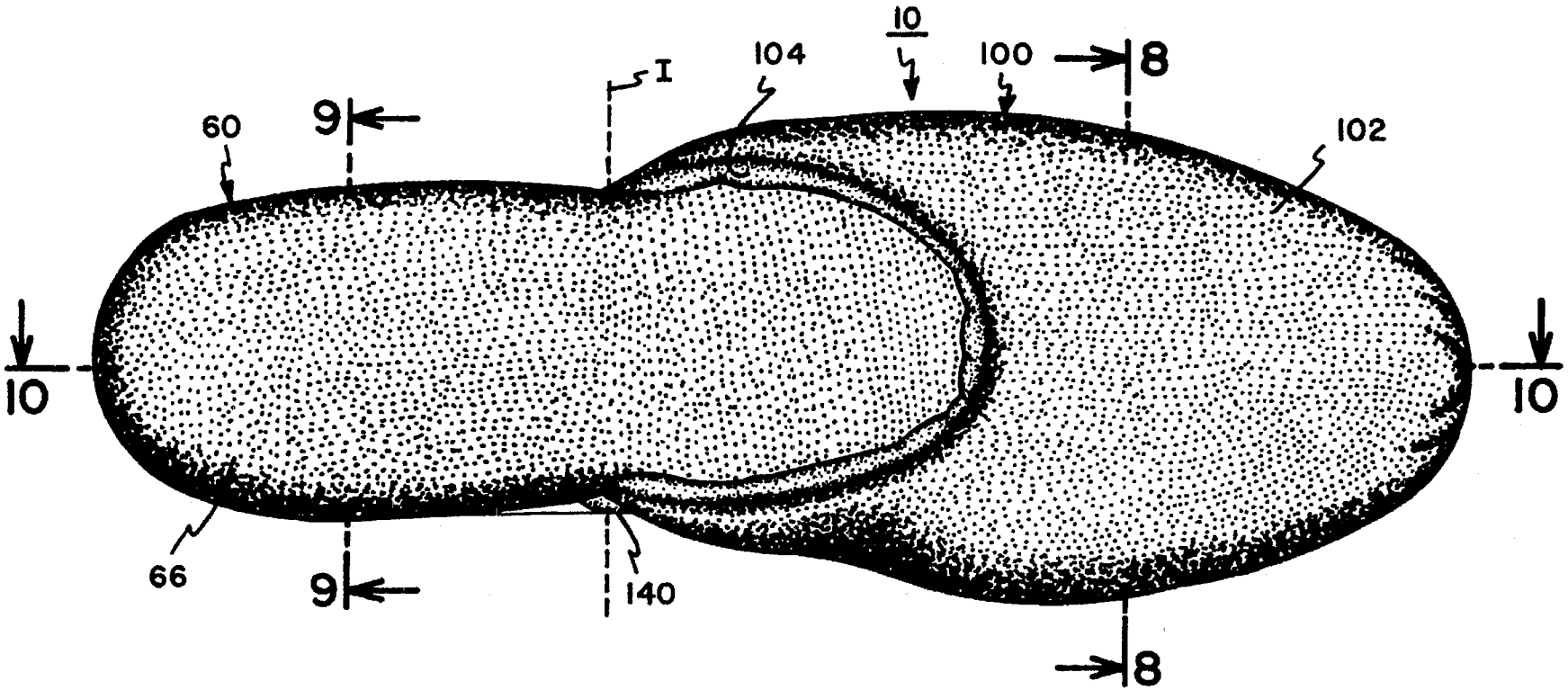
FIG. 4 is a top plan view of the footwear of FIG. 1.
Figure 5:
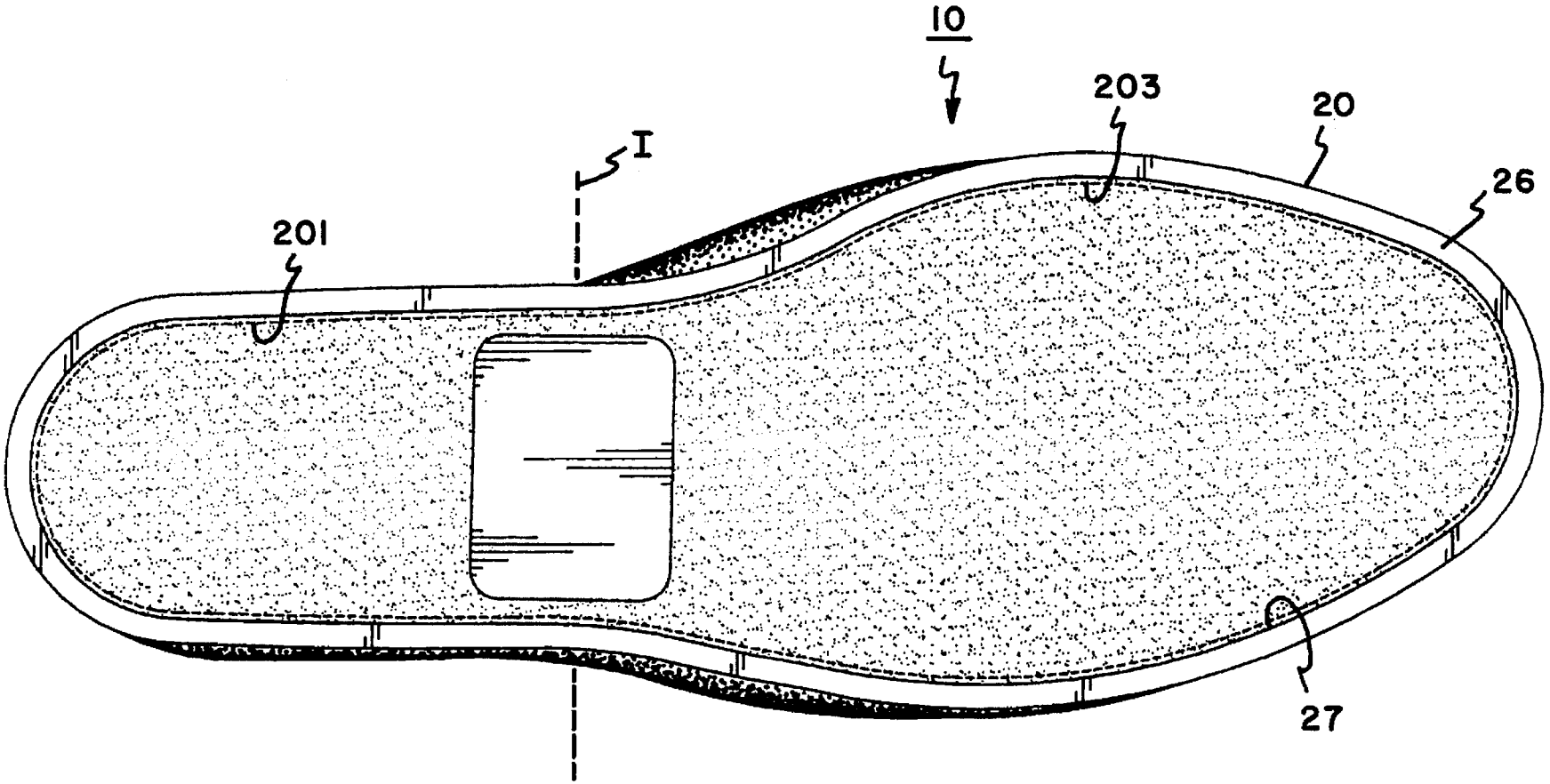
FIG. 5 is a bottom plan view of the footwear of FIG. 1.
Figure 6:
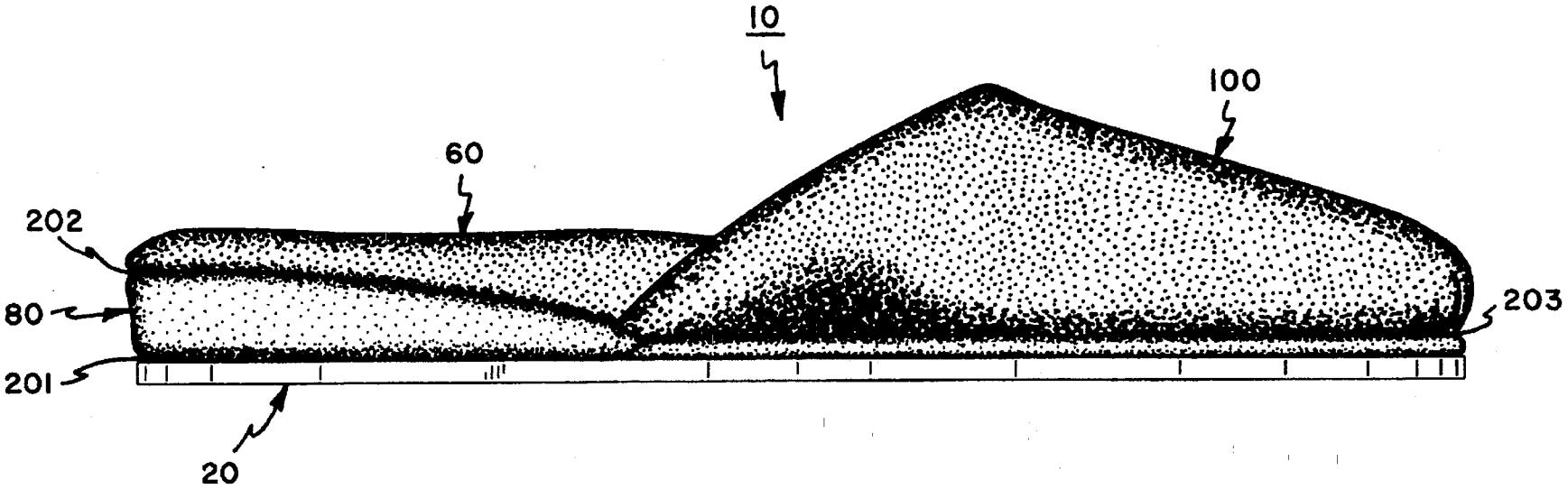
FIG. 6 is a right side elevation view of the footwear of FIG. 1.
Figure 7:
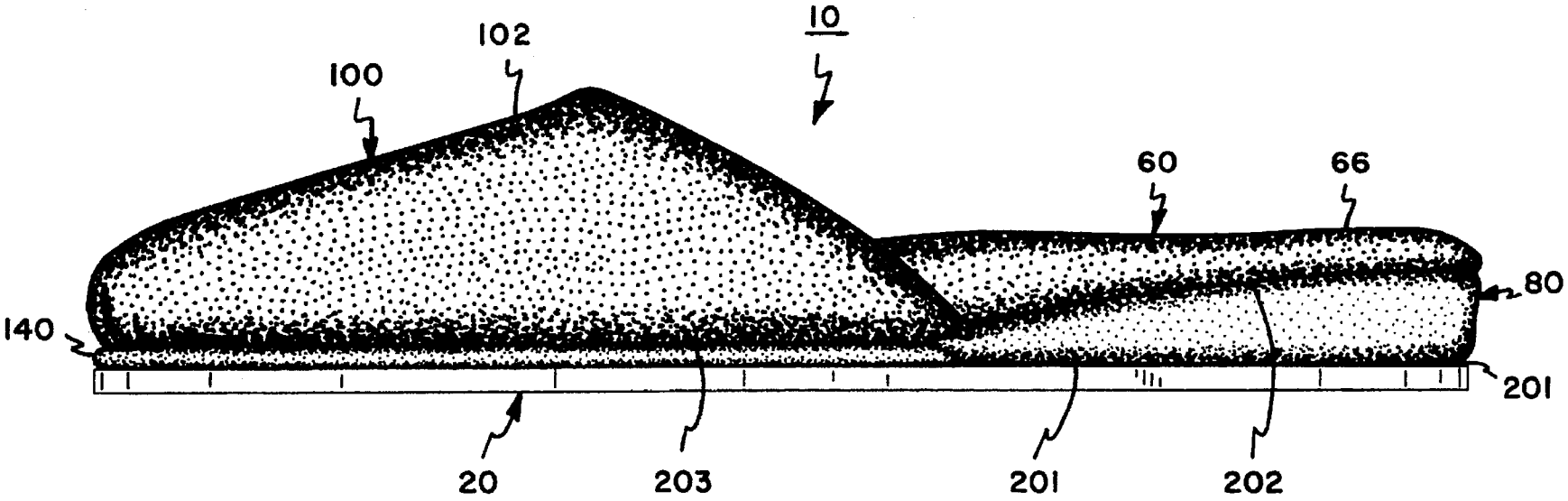
FIG. 7 is a left side elevation view of the footwear of footwear of FIG. 1.

The filler 40 extends from a toe end 42 to a heel end 44. The filler 40 has a bottom surface 46 position facing the upper surface 28 of outsole 20. The filler 40 also has an opposite upper surface Best shown in FIG. 10, the filler 40 varies in thickness along its length from toe portion 42 to heel portion 44. A first portion (A) extending from the toe 42 to an instep I (FIG. 4) is of generally constant thickness of foam material. A second portion (B) extending from point I to the heel 44 is of a varying thickness but thicker than portion A.

The varying thicknesses of the filler 40 is accomplished by its two-piece construction including a soft resilient foam layer 50 and a low density rubber wedge layer 52. The foam layer 50 is of equal thickness across the length from the toe 42 to the heel 44. The wedge layer 52 has a progressively increasing thickness and presents a wedge profile with a point 54 at the instep location I and a maximum thickness portion at heel and 44.

Figure 9:
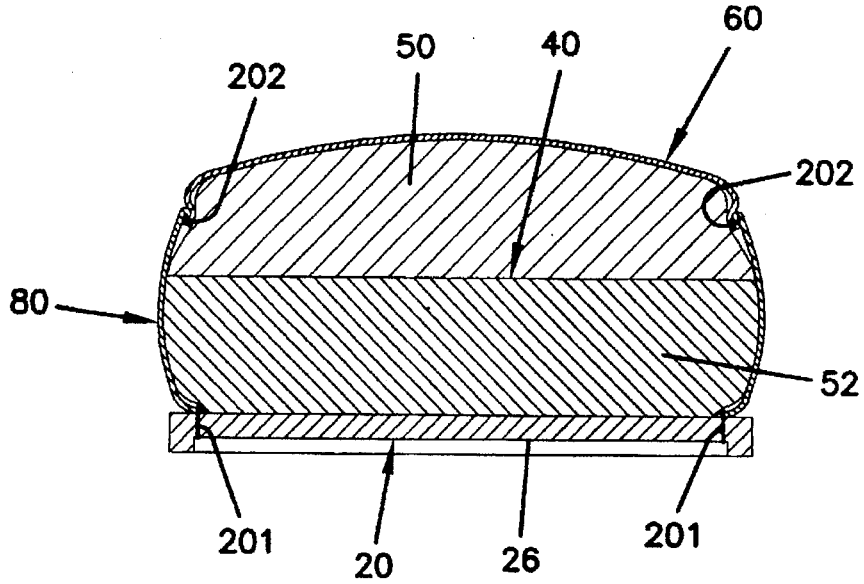
FIG. 9 is a view taken along line 9—9 of FIG. 4.
Figure 9A:
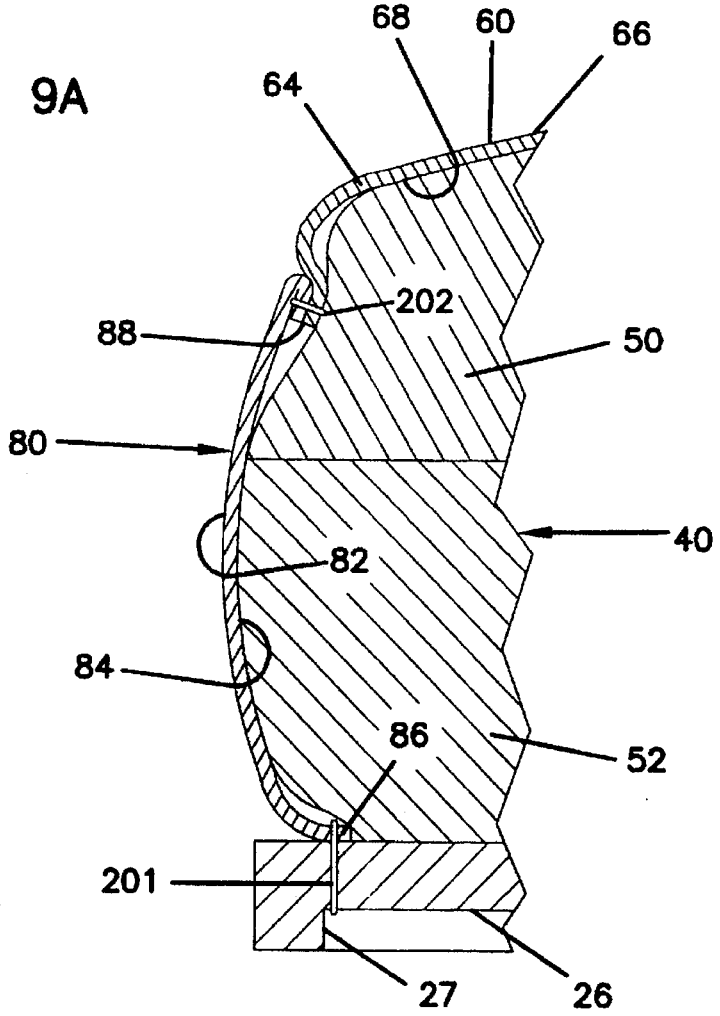
FIG. 9A is an enlarged view of the left hand side of the view of FIG. 9.

The wedge cover 80 (FIG. 9A) is a fabric material and has a finished surface 82 and an unfinished surface The fabric cover 80 extends from a lower peripheral edge 86 to an upper peripheral edge 88 (FIG. 9A).

Figure 10:
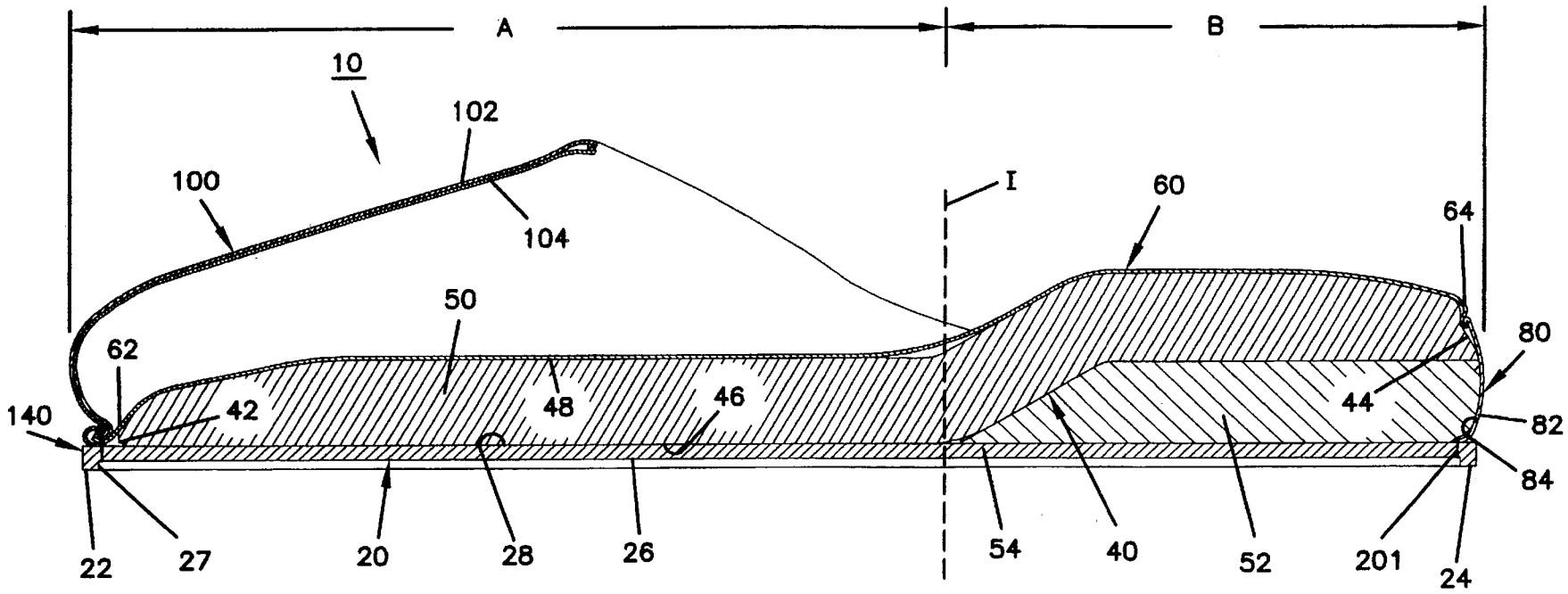
FIG. 10 is a view taken along line 10—10 of FIG. 4.

Best shown in FIGS. 9, 9A and 10, the bottom peripheral edge 86 is turned at a line of stitching 201 for the outer surface 82 to be facing toward the upper surface 28 of the outsole 20. By reason of the turned bottom peripheral edge 86, raw edges of the material of cover 80 are not exposed and the stitching line 201 is also unexposed.

The insole 60 extends from a toe end 62 to a heel end 64. The insole 60 is preferably formed of soft fabric such as terry cloth or the like and it has upper finished surface 66 and a lower unfinished surface 68 (FIG. 9A).

The insole 60 is disposed in overlying relation to the filler 40. The insole unfinished surface 68 faces toward the filler upper surface 48. As illustrated in FIG. 10, the insole 60, outsole 20 and filler 40 are aligned such that their respective heel ends and toes ends are in alignment.

The upper peripheral edge 88 of the wedge cover 80 is fastened to a first portion of the insole 60 along a second line of stitching 202. More specifically, the upper peripheral edge 88 is stitched to a peripheral edge of the insole 60 from instep location I and around the heel of the insole. At the second line of stitching 202, both of the peripheral edge of the insole 60 and the upper edge 88 of the wedge cover 80 are turned such that the finished surface 66 of the insole 60 and the outer surface 82 of the wedge cover 80 are facing toward one another at the second line of stitching 202 (FIG. 9A). This stitching prevents unsightly exposed raw edges of either the insole 60 or the wedge cover 80 as well as hiding the stitch line 202.

Figure 8:
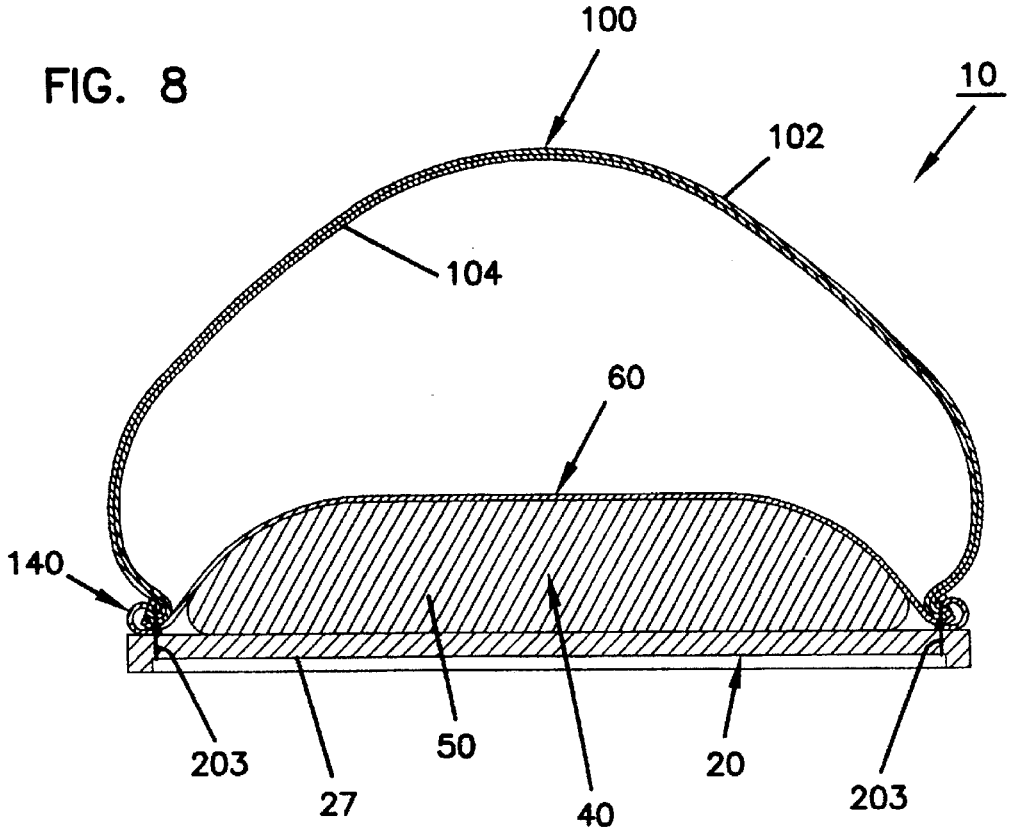
FIG. 8 is a view taken along line 8—8 of FIG. 4.
Figure 8A:
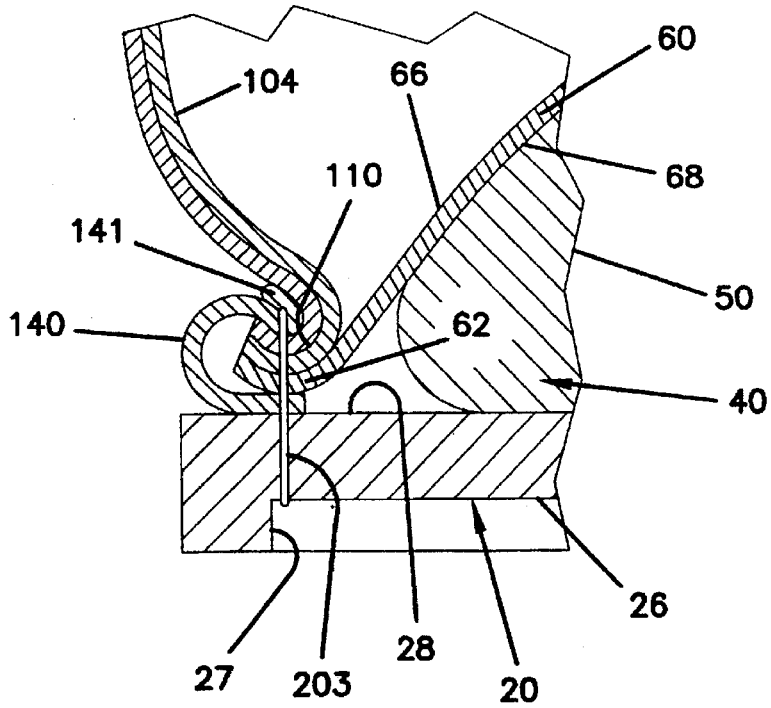
FIG. 8A is an enlarged view of a lower left hand corner of the view of FIG. 8.

The vamp 100 is also formed of fabric such as terry cloth or the like, and includes an outer surface 102 and an inner liner 104. The lower peripheral edge 110 (FIG. 8A) of the vamp 100 is disposed adjacent the peripheral edge 62 of the insole 60 from instep location I and around the toe. The vamp 100 has its inner surface 104 facing towards the outer surface 66 of the insole 60. The peripheral edge 110 of the vamp is fastened along a third line of stitching 203 to both the insole 60 and the outsole 20 from instep location I and around the toe. At the third line of stitching 203, the inner surface 104 of the vamp 100 faces the finished surface 66 of the insole 60. Further, the unfinished surface 68 of the insole 60 first faces the upper surface 28 of the outsole 20. The stitching 203 extends through the vamp 100, the insole 60 and the outsole 20 (FIG. 8A).

To avoid unsightly raw edges of the vamp 100 and insole 60, a fabric ribbon binder 10 (FIG. 8A) is provided which is folded onto itself to avoid presenting raw edges. The stitching 203 extends through the ribbon binder 140 in a conventional manner such that the ribbon covers the raw peripheral edges 110, 62 of the vamp 100 and insole 60 from the instep location I and around the toe.

With the construction thus described, applicant has provided a slipper having the traditional styling and wearer appeal of a wedge slipper. Unlike prior art slippers having molded styrofoam or carved wood wedges or leather lasted material, the present invention achieves the desired appearance of a vamp wedge slipper in a product which is light-weight, flexible and completely washable. Further, prior art designs of carved wood or molded styrofoam wedge slippers frequently require the use of adhesives to hold fabric uppers, bottoms and wedges together. The present invention achieves the hardened wedge support through the use of wedge 52 as well as presents a construction which avoids the need for adhesives and which results in a soft contoured finished silhouette allowing soft, finished edges to conform to the wearer's foot without yielding the heel and arch support. The completely sewn construction of the present invention provides a pocket into which the filler is received. This avoids the need for adhesives frequently used in the manufacture of wedge slippers.

Figure 11:
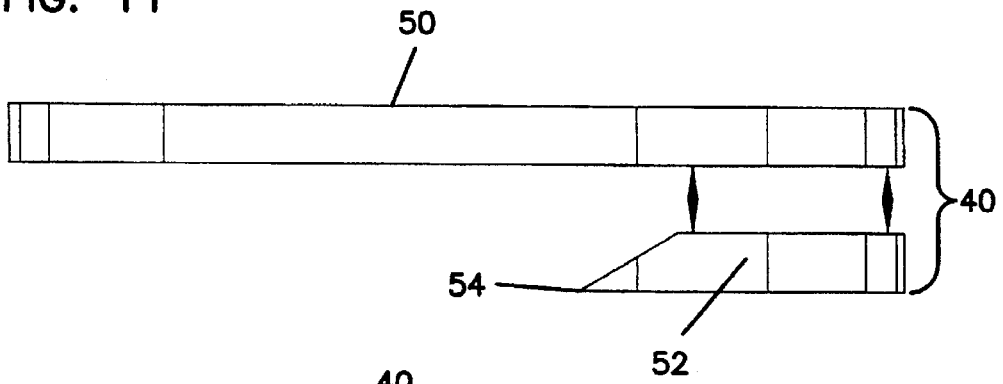
FIG. 11 is a side elevation view in exploded format showing elements of a cushion of the present invention.
Figure 12:
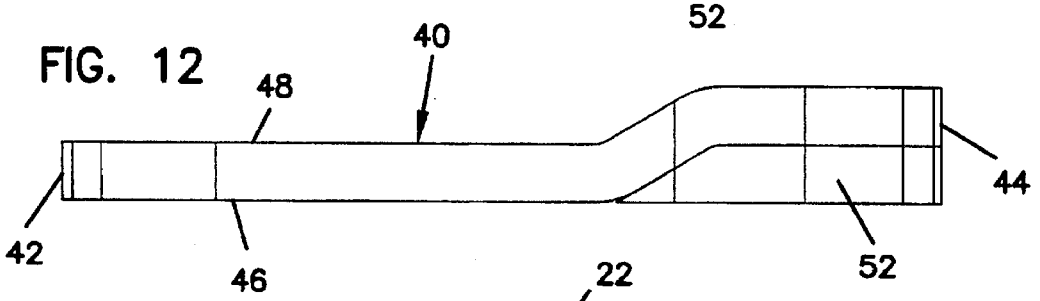
FIG. 12 is the view of FIG. 11 with the elements attached.

The construction of the present invention may be illustrated beginning with FIG. 11 which shows the formation of the filler 40. The cushioned layer 50 is adhered to the wedge layer 52 to form a completed filler 40 which achieves a thickened portion as best illustrated in FIG. 12.

Figure 13:
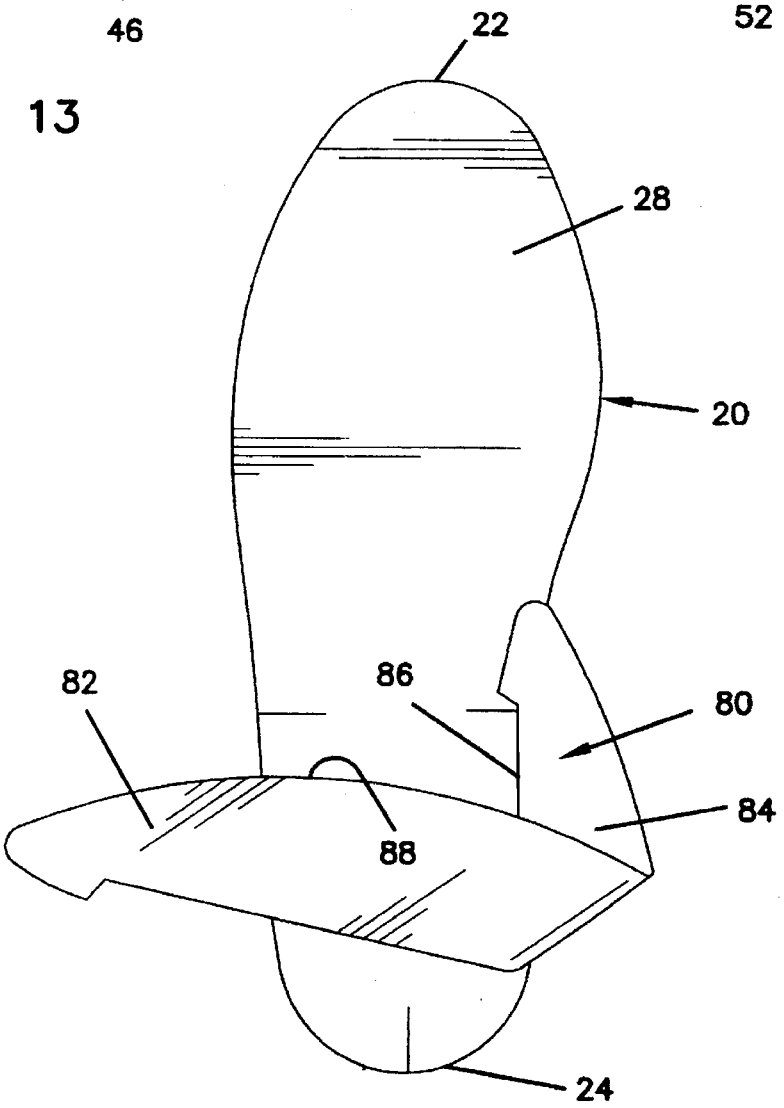
FIG. 13 is a view of a construction step for use in making the slipper of the present invention for attachment of a wedge cover to a sole.
Figure 14:
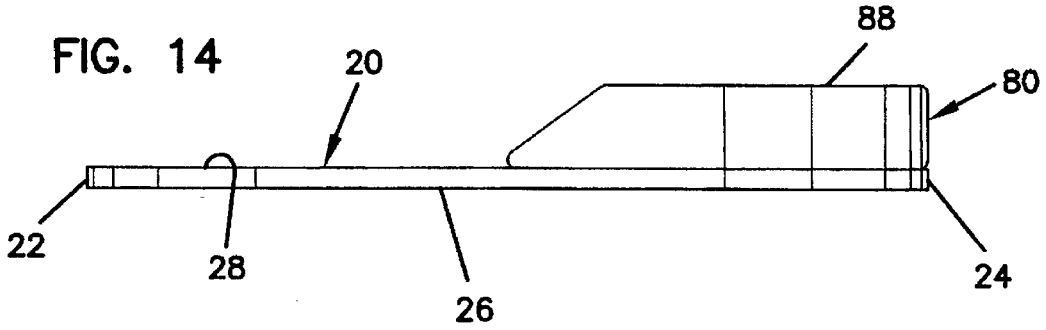
FIG. 14 is a side elevation view of a subassembly formed in FIG. 13.

FIG. 13 illustrates the stitching of the wedge cover 80 to the outsole 20. After the wedge cover 80 is stitched to the outsole 20, the final subassembly is shown in FIG. 14.

Figure 15:
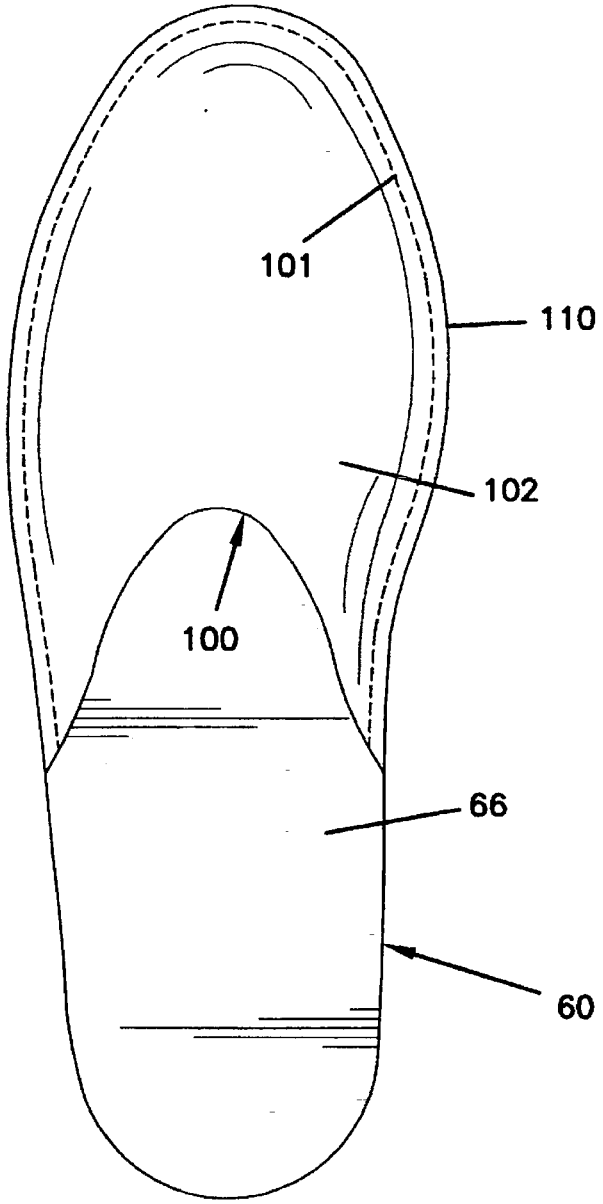
FIG. 15 is a top plan view of a subassembly of a vamp and an insole.
Figure 16:
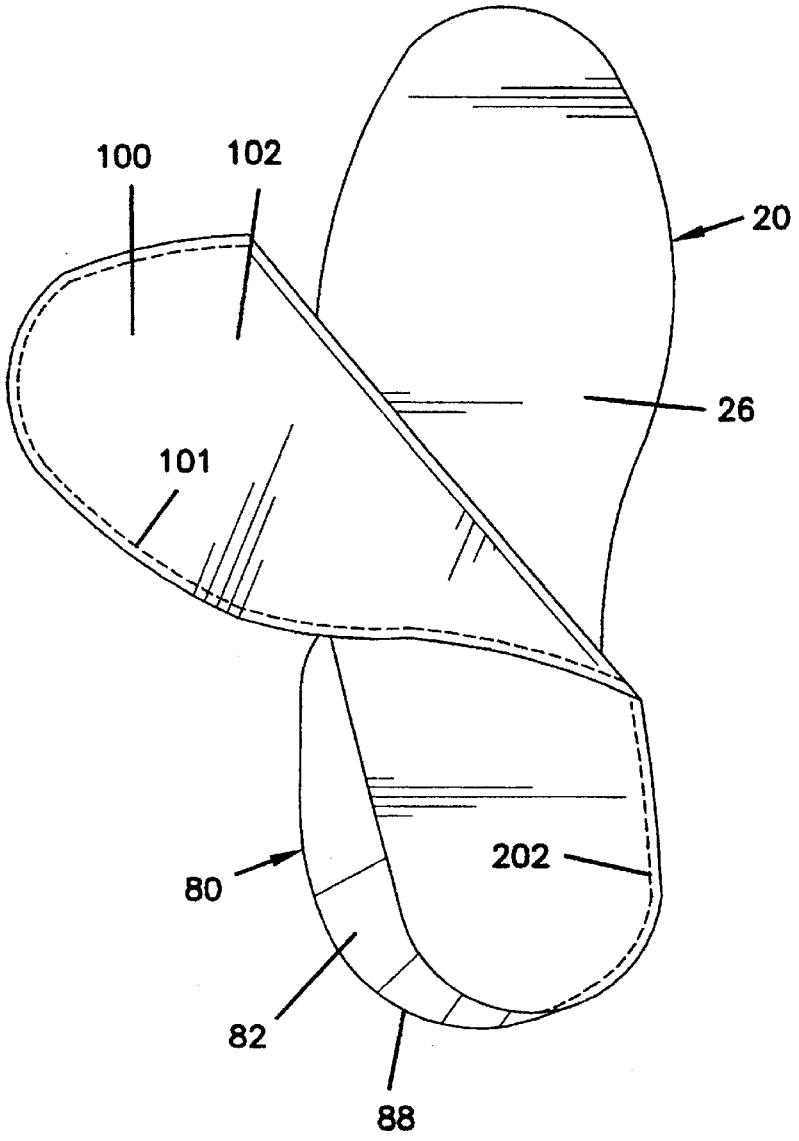
FIG. 16 is a view illustrating attachment of a subassembly of FIG. 14 to the subassembly of FIG. 15.

The vamp 100 is separately secured to the insole 60 by intermediate stitching 101 (shown only in FIGS. 157 and 16). The vamp peripheral edge 110 is stitched to the peripheral edge 62 of the insole 60 at the toe area to produce the subassembly of a vamp and insole shown in FIG. 15 where the vamp 100 is pre-stitched to the insole 60, such that the bottom surface of the vamp 100 faces the finished surface 66 of the insole 60 and without turning of any peripheral edges of either the vamp 100 or the insole 60. In the construction shown, the vamp is shown as an open toed vamp. It will be appreciated that the present invention is applicable to a wide variety of vamp styles including closed toed vamps or criss-crossing vamp fabrics.

The subassembly of the vamp/insole of FIG. 15 and the subassembly of the outsole/wedge cover of FIG. 13 are partially fixed together as illustrated in FIG. 16. As shown in FIG. 16, the wedge cover 80/outsole 20 subassembly is laid flat exposing the bottom surface 26 of the outsole 20 and the outer surface 82 of the wedge cover 80. The sock 60/vamp 100 subassembly is then placed over the outsole 20/wedge cover 80 subassembly such that the finished surface 66 of the insole 60 and the outer surface 102 of the vamp 100 are positioned facing the bottom surface 26 of the outsole 20. The heel area of the insole 60 is then stitched to the wedge cover upper surface by second stitch line 202. This stitching process results in a third finished subassembly shown in FIG. 17 where the subassembly is shown turned inside out such that the upper surface 102 of the vamp 100 and the finished surface 66 of the insole 60 are facing the bottom surface 26 of the outsole 20. This assembly step creates an encapsulating heel cavity which will receive the product filler 40. It will be noted that this cavity, unlike many art designs, has been created without the use of adhesives but completely through sewn techniques.

Figure 17:
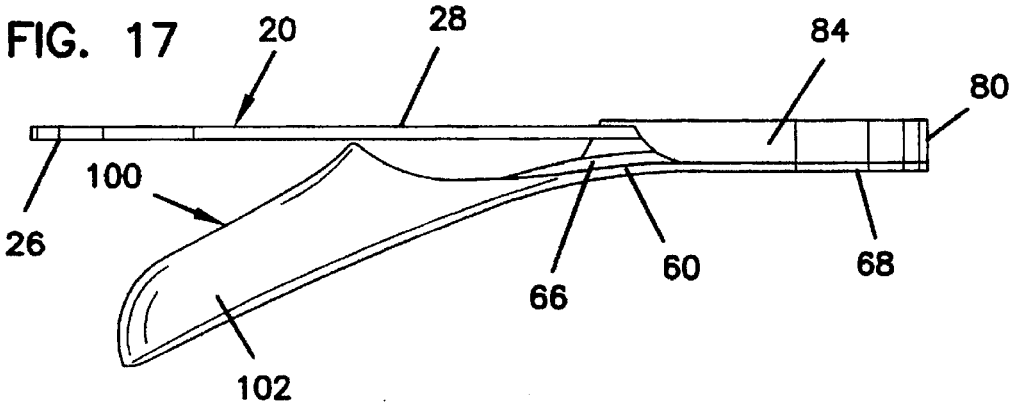
FIG. 17 is a side elevation view of the finished subassembly of FIG. 16.
Figure 18:
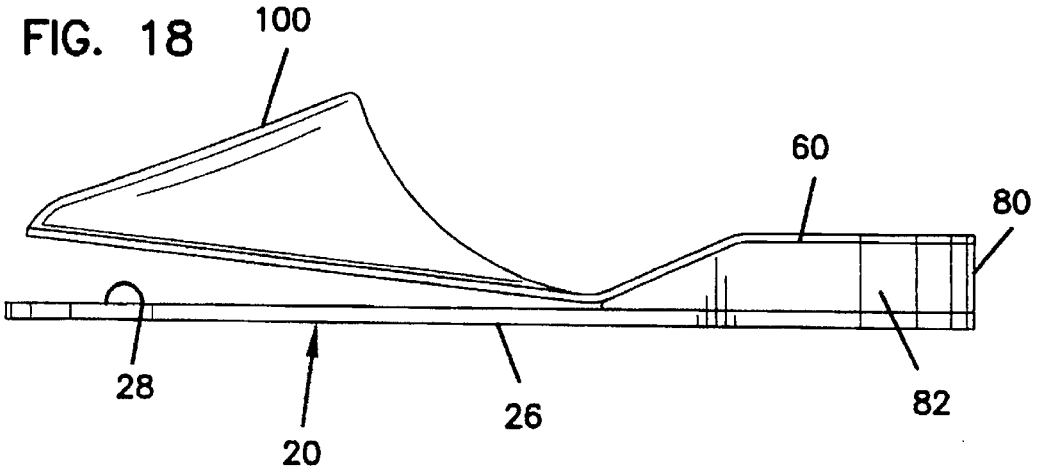
FIG. 18 is a view of the subassembly of FIG. 17 shown inverted.
Figure 19:
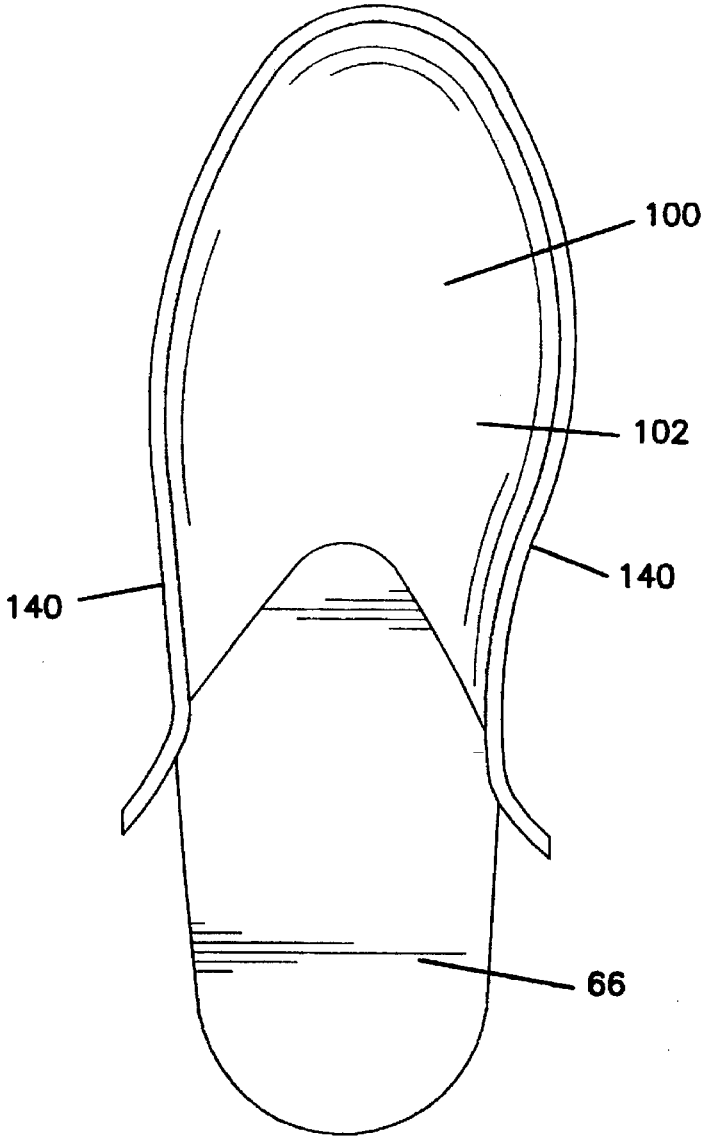
FIG. 19 is a top plan view of the subassembly of FIG. 18 showing attachment of a binding ribbon.

The subassembly of FIG. 17 is inverted to the view of FIG. 18. The inversion causes the material at the stitching lines 201, 202 to turn resulting in the smooth contoured looks and the avoidance of any raw edges as well as the avoidance of exposed stitching. Since the toe area of the insole and the outsole are unattached, there is an exposed entry to the cavity defined by the wedge cover 80, insole 60 and outsole 20. The binding ribbon 140 is now pre-stitched around the raw edges of the vamp 100 and the insole 60 as illustrated in FIG. 19. The binding includes extended lengths which may be turned under later in the construction to avoid exposing raw edges.

Figure 20:
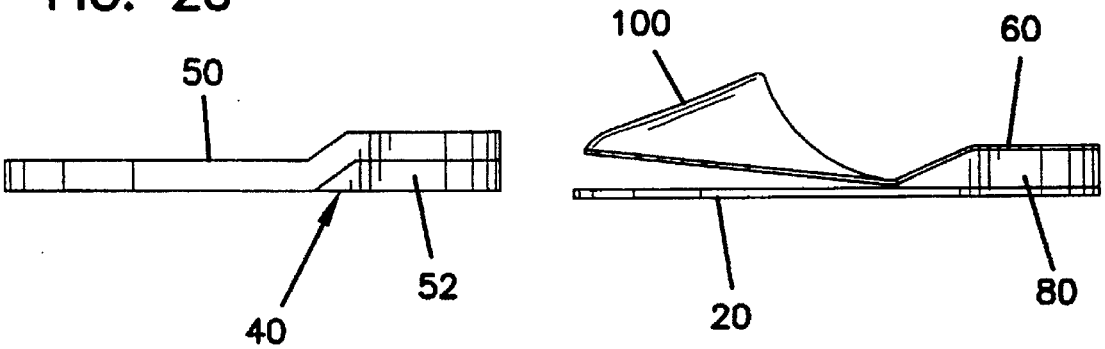
FIG. 20 is a view of the filler o FIG. 12 being inserted into the assemblies of FIGS. 18 and 19.

After the binding 140 has been attached as indicated in FIG. 19, the filler 40 may be inserted into the cavity as indicated in FIG. 20. The excess of the binding 140 may be turned under the filler 40 such that the raw ends of the binding 140 are within the cavity and then the binding 140 can be stitched through by stitching 203 to completely bind the vamp 100, insole 60, binding 140 to the outsole 20. With this line 203 of stitching, the binding 140 generates a flap 141 (FIG. 8A) which folds over itself to cover the stitching 203.

From the foregoing detailed description the present invention it has been shown on the objects of the invention have been obtained in a preferred manner. Applicant has produced a slipper with a wedge style and benefits and with a smooth contour and comfort not found in previous designs. Further, the design avoids unsightly exposed stitching or unsightly exposed raw edges and further avoids the need for adhesives joining the fabric material to the wedge of the slipper.

I claim:

1. An article of footwear comprising:

an outsole extending from a toe end to a heel end and having a ground engaging bottom surface and an upper surface;

a cushion filler having a bottom surface and an upper surface and extending from a toe and to a heel end, said filler positioned in overlying relation on said upper surface of said outsole with said toe and heel ends of said filler aligned with said toe and heel ends of said outsole;

said filler having a varying thickness from a first thickness portion at said toe end and an enlarged second thickness portion at said heel end, said second thickness portion presenting a raised surface at said heel end and extending upwardly away from said outsole;

a fabric cover having an outer finished surface and an inner unfinished surface, said cover sized to wrap around said raised surface of said filler;

a bottom peripheral edge of said cover fastened at a first line of fastening to said outsole at said outsole heel end and with said finished surface of said cover at said bottom peripheral edge turned to be facing toward said upper surface of said outsole and with said bottom peripheral edge of said cover folded inwardly to be disposed between said filler and said outsole, said unfinished surface of said cover facing said raised surface of said filler, said cover having an upper peripheral edge adjacent said upper surface of said filler;

a fabric insole having a finished surface and an unfinished surface and extending from a toe end to a heel end, said insole disposed in overlying relation to said filler with said insole unfinished surface facing toward said filler upper surface, said toe ends of said insole, outsole and filler in alignment and said heel ends of said insole, outsole and filler in alignment opposing surfaces of said insole and said outsole defining an uninterrupted chamber extending from said toe end to said heel end with said filler received within said chamber;

said upper peripheral edge of said cover fastened along a second line of fastening to a first position of a peripheral edge of said insole adjacent said upper peripheral edge, said finished surfaces of said cover and said insole turned at said second line of fastening for said finished surfaces of said cover and said insole to be facing toward each other along said second line of fastening;

a vamp having an inner surface and an outer surface and having a peripheral edge, said vamp positioned with said inner surface of said vamp facing toward said finished surface of said insole at said insole toe end;

said peripheral edge of said vamp fastened along a third line of fastening to a second portion of said peripheral edge of said insole adjacent said peripheral edge of said vamp and to said outsole, said inner surface of said vamp facing toward said finished surface of said insole at said third line of fastening, said unfinished surface of insole facing toward said upper surface of said outsole at said third line of fastening, said peripheral edge of said vamp and said second portion disposed extending away from said filler.

2. An article of footwear according to claim 1 wherein said filler is of generally uniform thickness throughout said first thickness portion and of increasing thickness in said second thickness portion from said first thickness portion to a heel of said filler.

3. An article of footwear according to claim 2 wherein said filler includes a resilient cushion extending from said heel end to said toe end and a hard wedge in face-to-face relation thereto at said heel end.

4. An article of footwear according to claim 1 wherein said first line of fastening extends generally from a first point on an instep area of said outsole and around said heel end of said outsole to a second point on a side of said outsole opposite said instep area.

5. An article of footwear according to claim 4 wherein said third line of fastening extends from said first point around said toe end of said outsole and to said second point.

6. An article of footwear according to claim 1 comprising a binding ribbon covering said peripheral edges of said vamp and said second portion of said insole and fastened thereto at said second line of fastening.

7. An article of footwear according to claim 6 wherein said third line of fastening is a stiching extending through said outsole, said vamp, said ribbon and said insole.

8. An article of footwear according to claim 1 wherein said upper surface of said outsole is generally flat.

9. An article of footwear according to claim 1 wherein said first line of fastening is a stitching extending through said outsole and said cover.

10. An article of footwear according to claim 1 wherein said second line of fastening is a stitching extending through said insole and said cover.

11. An article of footwear according to claim 1 wherein said third line of fastening is a stitching extending through said outsole, said vamp and said insole.

* * * * *